US005929004A

United States Patent [19]

Ushijima et al.

[11] Patent Number: 5,929,004

[45] Date of Patent: Jul. 27, 1999

[54] DETERGENT FOR CLEANING TIRE WHEELS AND CLEANING METHOD

[75] Inventors: Takashi Ushijima, Yokohama; Atsushi Ikeda, Fujisawa; Seigo Shinohara, Chigasaki; Tetsuo Kijima, Machida, all of Japan

[73] Assignee: No Touch North America, Irvine, Calif.

[21] Appl. No.: 08/948,577

[22] Filed: Oct. 10, 1997

[51] Int. Cl.[6] ..... C11D 1/37; C11D 3/30

[52] U.S. Cl. ..... 510/100; 510/189; 510/245; 510/428; 510/435

[58] Field of Search ..... 510/435, 199, 510/238, 245, 241, 189, 191, 426, 100, 428

[56] References Cited

U.S. PATENT DOCUMENTS 4,777,018 10/1988 Auchincloss ..... 422/28
4,793,988 12/1988 Casey et al. ..... 424/7.1
5,362,422 11/1994 Masters ..... 252/544

*Primary Examiner*—Yogendra N. Gupta
*Assistant Examiner*—Gregory E. Webb
*Attorney, Agent, or Firm*—Browdy and Neimark

[57] ABSTRACT

This invention there provides a detergent for cleaning tire wheels, which is applied in a foamy state onto the tire wheels, thereby allowing a grime adhered to the surface of the tire wheels to come off from the tire wheels, which contains a surfactant, at least one alkali compound selected from the group consisting of ammonia and amino group-containing alkali compounds, and a color change indicator capable of changing its own color when transferred from an alkaline condition to a neutral condition, in which the alkali compound is contained in the detergent in such an amount that the compound is eliminated from the detergent by reaction with carbon dioxide for the same period of time as required to release most amounts of grime from the surface of tire wheels, and a method of cleaning tire wheels with the detergent.

10 Claims, No Drawings

DETERGENT FOR CLEANING TIRE WHEELS AND CLEANING METHOD

BACKGROUND OF THE INVENTION

1. Field of the Invention

The present invention relates to a detergent for cleaning tire wheels and a method of cleaning tire wheels with the detergent, more particularly to a detergent for cleaning tire wheels which enables one to recognize the point when its ability to remove grime becomes lost with eyes and a method of cleaning tire wheels with the detergent.

2. Description of Related Art

Tire wheels are mounted on tires of automobiles and hence a variety of grime can be deposited on the tire wheels in an amount increased with time.

For example, brake disks are mounted near the wheels, and dust particles produced from the brake pad or brake lining are deposited on the tire wheels. Furthermore, the wheels splash mud on themselves during the running of automobiles. When automobiles run on asphalted roads, fine particles of petroleum products such as pitch are also deposited on the wheels. Thus, a variety of grime can stick onto the wheels.

The grime sticks onto the tire wheels in the following manner: dust particles themselves rubbed off from the brake pad or brake lining do not stick onto the wheel surface. The materials derived from air and/or roads act as an adhesive to allow the dust particles adhere to the wheel surface.

Dirty tire wheels are washed with a surfactant-based detergent. In this case, the detergent is sprayed onto the wheels in a foamy state. The foamy detergent-applied wheels are left standing as it is for a while. Thus, the materials for adhering the metal particles, stone particles and petroleum solid particles onto the wheels are wetted with the foamy detergent, thereby allowing the foamed detergent to take these particles therein, and then allowing these particles to leave the surface of the wheels or float over the surface of the wheels. Finally, the foamy detergent takes the grime particles therein.

Thereafter, the detergent can be wiped off or removed away by water.

However, it is uncertain to users or customers how long it requires for the detergent to swell the grime, penetrate in to it and finally remove the dust particles, mud and petroleum product particles from the wheels. Furthermore, the time required for the detergent to eliminate these particles varies depending upon the deposited amounts of the particles and/or applied detergent. In short, in eliminating an entirety of grime sticking onto the wheels, it is uncertain to users or customers what amount of detergent should be used, and how long the detergent should be left on the wheels before removed away.

Therefore, nowadays an amount of most commercially available detergents used has to be measured by eyes, and the applied detergents have to be removed in a time decided by users themselves by guess.

There may occur such problems that the tire wheels are not well cleaned because of the time decided being too short or damaged with the detergent because of the time decided being too long.

SUMMARY OF THE INVENTION

The first object of the present invention is to provide a detergent for cleaning tire wheels, which enables one to easily know the timing for removing the detergent, in which the grime adhered to the tire wheels is included, from the wheels by color change of the detergent, and to provide a method of cleaning tire wheels with the above-mentioned detergent.

The second object of the present invention is to provide a detergent for cleaning tire wheels, which enables one to accurately recognize the point when the detergent's ability to remove grime becomes lost, and gives a high degree of cleaning effect without damaging the tire wheels, even though the detergent is left on the tire wheels for a long time, and to provide a method of cleaning tire wheels with the above-mentioned detergent.

DISCLOSURE OF THE INVENTION

In a well-known tire wheel cleaning method, a foamy detergent is applied onto a tire wheel having grime adhered thereto, and then the grime is released with the foamy detergent from the surface of the tire wheel. According to the present invention, the detergent is featured by comprising a surfactant, at least one alkali compound selected from the group consisting of ammonia and amino group-containing alkali compounds, and a color change indicator capable of changing its own color when turned from an alkaline condition to a neutral condition, and the alkali compound is contained in the detergent in such an amount that the compound is eliminated from the detergent by reaction with carbon dioxide for the same period of time as required to release most amount of grime from the surface of tire wheels.

In one embodiment, the above-mentioned tire wheel-cleaning detergent may contain a color pigment or dye. In another embodiment, the detergent may contain an anionic and/or nonionic surfactant as the above-mentioned surfactant. In a further embodiment, the above-mentioned anionic surfactant may be at least one salt selected from the group consisting of alkylbenzene sulfonates, alkyl sulfosuccinates and mixtures thereof. In a still further embodiment, the above-mentioned amino group-containing alkali compound may be at least one alkali compound selected from the group consisting of morpholine and alkanolamines.

The color change indicator used in the present invention may be phenolphthalein which can change its own color when turned from alkaline condition to acidic condition.

In one of the preferred embodiments of the present invention, the above-mentioned detergent for cleaning tire wheels is applied in a foamy state onto the tire wheels, and the foamy detergent on the tire wheels is removed only when the original color of the foamy detergent is changed to another color.

BEST MODES OF WORKING FOR THE PRESENT INVENTION

The detergent for cleaning tire wheels according to the present invention is applied in a foamy state onto the surface of the tire wheels to swell grime adhered to the tire wheels, particularly metal particles, stone particles, mud particles and particles of materials such as petroleum solid products consolidating the grime, or penetrate into such materials to soften the grime, and then the applied detergent is left to stand for a predetermined time to take the grime into the foam of the detergent, thereby providing the cleaning effect.

The detergent contains the surfactant to obtain this cleaning effect.

As the surfactant, reference may be made to anionic surfactants, amphoteric surfactants and nonionic surfactants.

As the anionic surfactant, reference may be made to salts of organic acids such as carboxylates and sulfonates, salts of sulfuric esters and salts of phosphoric esters.

As the carboxylates, reference may be made to salts of higher fatty acids such as sodium laurate, potassium laurate, sodium myristate, sodium palmitate, sodium stearate, sodium oleate, potassium oleate and ether carbonate, or salts of alkyl sulfo-fatty acids represented by the formula of $MO_3SCH(CH_2COOR_1)\ COOR_2$, wherein $R_1$ and $R_2$ both may be a hydrocarbyl group, preferably an alkyl group, and M may be a metal or an organic base, particularly preferably sodium, potassium, ammonium, amine and triethanolamine. As the salts of alkyl sulfofatty acids reference may be made to alkyl sulfosuccinates such as monoalkyl sulfosuccinates and dialkyl sulfosuccinates.

As the sulfonates, reference may be made to sulfonates such as higher alkyl sulfonates, α-olefin sulfonates, sulfonates of higher fatty esters, dialkyl sulfosuccinates, sulfonates of higher fatty amides, and a formalin condensate of alkylaryl sulfonates such as an alkylbenzene sulfonate and alkylnaphthalene sulfonate and alkylaryl succinates. The above-mentioned salts of alkyl sulfo-fatty acids can be represented by the formula of $MO_3SCH(CH_2COOR_1)\ COOR_2$, wherein $R_1$ and $R_2$ both may be a hydrocarbyl group, preferably an alkyl group, and M may be a metal or an organic base, particularly preferably sodium, potassium, ammonium, amine and triethanolamine.

As the salts of sulfuric esters, reference may be made to sulfuric ester salts of higher alcohols, sulfuric ester salts of higher secondary alcohols, sulfuric ester salts of alkyl ethers, sulfuric ester salts of alkylaryl ethers, alkyl sulfuric ester salts, sulfuric ester salts of higher fatty esters, sulfuric ester salts of higher fatty alkylolamides, and sulfurized petroleum.

As the salts of phosphoric esters, reference may be made to sodium didecyl phosphate, sodium polyoxyethylenelaurylether phosphate, sodium polyoxyethylenecetyl ether phosphate, sodium polyoxyethyleneoleil ether phosphate and sodium polyoxy-ethylene alkylphenyl ether phosphate.

As the amphoteric surfactant, reference may be made to N-lauryl -β-alanine, N-stearyl β-alanine, N,N,N-trimethylamino-propionic acid, N-hydroxylethyl. N,N-dimethylaminopropionic acid, N-methyl N,N-dihydroxyethylaminopropionic acid, N,N,N-trihydroxyethylaminopropionic acid, N-lauryl N,N-dimethylamino-propionic acid, N-myristyl N,N-dimethylaminopropionic acid, N-palmityl N,N-dimethylaminopropionic acid, N-stearyl N,N-dimethylaminopropionic acid, N-hexyl N,N-dimethylaminoacetic acid, N-octyl N,Ndimetylaminoacetic acid, N-decyl N,N-dimethyl-aminoacetic acid, N-undecyl N,N-dimethylaminoacetic acid, N-lauryl N,N-dimethylaminoacetic acid, N-myristyl N,N-dimethylaminoacetic acid, N-palmityl N,N-methylaminoacetic acid, N-stearyl N,N-dimethylaminoacetic acid, 1-pyridium betain and 1-α-picolinium betain.

As the nonionic surfactant, reference may be made to nonionic surfactants of an ether type, ether-ester type, ester type and block polymer type and a nitrogen-containing nonionic surfactant.

The nonionic surfactant of an ether type may be surfactants of a single-chain chain polyoxyethylene ether type; polyoxyethylene-alkyl or alkylaryl ethers such as polyoxyethylene-aliphatic alcohol ether, poyoxyethylene-alkylaryl ether type and polyoxyethylenelanolin alcohol; and an ethylene oxide derivative of an alkylphenol-formalin condensate.

The nonionic surfactant of an ether-ester type may be an ester bond-containing polyoxyethylene ether such as polyoxyethylenesorbitan-fatty ester, polyoxyethyleneglyceryl-mono-fatty ester, polyoxyethylenepropyleneglycol-fatty ester and polyoxyethylenesorbitol-fatty ester; and a polyoxyethylene derivative of a natural fatty, oil and wax.

The nonionic surfactant of an ester type may be a polyoxy-ethylene-fatty ester and polyalcohol ester.

The nonionic surfactant of a block polymer type may be surfactants of a Pluronic type and of a Tetronic type and an alkyl; group-containing block polymer.

The nitrogen-containing nonionic surfactant may be polyoxy-ethylene-fatty amide, alkylol amide and polyoxy-alkyl amine.

Of these surfactants are preferred the anionic surfactant and nonionic surfactant. Of the anionic surfactants are preferred the alkylbenzene sulfonates and alkylbenzene succinates. The combined use of the alkylbenzene sulfonates and alkylbenzene succinates is particularly preferred.

In the present invention, the content of the anionic surfactant is normally in the range of 0.1–10% by weight, preferably 4–7% by weight, of the detergent.

The detergent of the present invention contains at least one alkali compound selected from the group consisting of ammonia and amino group-containing alkali compounds, and a color change indicator.

As the above-mentioned amino group-containing alkali compounds, reference may be made to morpholine, alkanolamines, aniline, alkylamines and alkylenediamine. The alkanolamine may be monomethanolamine, monoethanolamine and monopropanolamine. The alkylamine may be ethylamine and propylamine. The alkyl-diamine may be ethylenediamine.

In the present invention, the alkali compound is contained in such an amount that the detergent can turn from neutral to acidic by reaction with carbon dioxide for the same period of time as that required for the detergent to allow the grime on tire wheel to come off from the tire wheel.

That is, when the detergent is sprayed in a foamy state, the alkali compound in the detergent begins to react with carbon dioxide in atmosphere, and concurrently the detergent begins to allow the grime on tire wheels to be softened, swollen and wetted. Thus, the total amount of the alkali compound should be completely reacted with carbon dioxide when substantially whole amounts of the grime adhered to the surface of tire wheels are taken into the foamy detergent.

The cleaning effect by which the grime on the surface of tire wheels is taken into the foamy detergent varies depending upon the composition of the detergent and, therefore, the content of the alkali compound to be contained in the detergent should be experimentally determined for each of the detergents.

In one embodiment of the present invention, the content of the alkali compound may be normally in the range of 0.1–2% by weight, preferably 0.4–1% by weight, for ammonia. In another embodiment, it may be normally in the range of 0.5–3% by weight, preferably 1–2% by weight, for the amino group-containing alkali compound.

If the content of ammonia and the amino group-containing alkali compound is less than the above-mentioned range, the color changing time may be too short to allow the grime to adequately come off from the tire wheels. On the other hand, if this content is more than the above-mentioned range, then an offensive smell may be emitted so that cleaning work is made hard, or an excess of the alkali compound is brought into contact with the tire wheels so that the tire wheels may be damaged.

In the present invention, in order to raise the stability of the alkali compound in the detergent, an alkali salt of an organic acid such as ammonium benzoate, ammonium acetate, sodium acetate, ammonium oxalate and sodium oxalate may be contained in the detergent.

The detergent of the present invention contains a color change indicator capable of discoloring when changed from alkaline to neutral. As the color change indicator, reference may be made to a pH indicator such as phenolphthalein, thymol blue, thymolphthalein and phenol red.

The detergent of the present invention is featured in that it can show the point when the ability to remove the grime becomes lost. Therefore, one or both of a pigment and dye may be used together with the color change indicator. Such pigment or dye may be iron oxide yellow, phthalocyanine green, phthalocyanine blue, brilliant blue FCF, acid red and sunset yellow FCF.

Of these color change indicators, are preferred phenolphthalein and thymolphthalein. To these it is preferred to add phthalocyanine blue as pigment or dye.

The content of the color change indicator in the detergent varies depending upon the content of the alkali compound in the detergent, and should be adjusted so that the color change indicator may have a color under neutral condition when the detergent having been applied to tire wheels turns to neutral. Generally, it may be in the range of 0.001–2% by weight, preferably 0.005–0.2% by weight. If it is less than the range, then the clear finish point cannot be recognized. On the other hand, if it is more than the range, then no additional effect can be expected by the increased amount.

The detergent of the present invention contains water and a water-soluble alcohol as solvent. The water-soluble alcohol may be methanol, ethanol, isopropanol and butanol. These water-soluble alcohols can act as a solvent for the color change indicator. Furthermore, water can also act as a solvent for the detergent.

The detergent of the present invention may also contain a silicone oil, modified silicone oil, liquid paraffin and polybutene for affording water repellency to the cleaned surface of tire wheels. Furthermore, it may contain a hydrocarbon solvent for improving the detergency for oily grime, thereby forming a uniform emulsified detergent.

The detergent of the present invention is prepared by mixing some or all of the above-mentioned components.

The cleaning of dirty tire wheels and recognition of the point when the ability to remove the grime becomes lost can be made by using the detergent of the present invention as follows:

The detergent of the present invention may normally be canned in an aerosol form or packed in a hand-spray container. Furthermore, it may be applied to the surface of tire wheels with cloth and sponge.

In the case where the detergent is packed in an aerosol can or hand-spray container, it is deposited on the tire wheels in a foamy state when sprayed. Directly after the detergent is applied, the alkali compound is not vaporized, and the reaction of the compound with carbon dioxide in air does not proceed and hence the detergent remains alkaline. Thus, the detergent as sprayed has a color. Leaving the foamy detergent on tire wheels will allow the neutralization of the alkali compound with carbon oxide in air to proceed.

The neutralization proceeds to spend the amount of the alkali compound, thereby allowing the detergent to transfer in a neutral condition and change its own color. For example, the detergent turns from blue to yellow in the case where the color change indicator is thymol blue, from pink to colorless in the case where the indicator is phenolphthalein, from red to yellow in the case where the indicator is phenol red.

The change of the detergent reveals that the grime on the tire wheels has been taken into the foamy detergent. Thereafter, the detergent is wiped off or washed away with water.

The present invention will be illustrated below with reference to some examples.

EXAMPLE 1

A detergent for cleaning tire wheels was prepared to have the following composition:

| | |
|---|---|
| Sodium alkylbenzene sulfonate | 1% by weight |
| Sodium alkylsulfosuccinate | 1.5% by weight |
| Deionized water | residual quantity |
| Isopropyl alcohol | 5% by weight |
| Phenolphthalein | 0.005% by weight |
| Morpholine | 2% by weight |

The resulting detergent was packed in an aerosol can and sprayed onto a tire wheel made of aluminum from the aerosol can. Thus, the detergent was deposited in a foamy state on the entire surface of the wheel and had a pink color as sprayed, and then left standing for a while as it was. The color of the detergent gradually faded, and finally the detergent turned colorless. Thereafter, the detergent was hosed off from the wheel. The wheel was observed to be thoroughly cleaned.

EXAMPLE 2

A detergent for cleaning tire wheels was prepared to have the following composition:

| | |
|---|---|
| Sodium alkylbenzene sulfonate | 4% by weight |
| Sodium alkylsulfosuccinate | 2% by weight |
| Synthetic hydrocarbon solvent ("Isopar M" made by EXXON CHEMICAL INC.) | 40% by weight |
| Silicone Oil | 3% by weight |
| Deionized water | residual amount |
| Phenolphthalein | 0.05% by weight |
| Isopropyl alcohol | 5% by weight |
| Morpholine | 2% by weight |

The resulting detergent was sprayed onto the dirty surface of a tire wheel in the same manner as in Example 1. Thus, the detergent was foam-sprayed onto the entire surface of the wheel and had a pink color as sprayed, and then left standing for a while as it was. The color of the detergent gradually faded, and finally the detergent turned colorless. Thereafter, the detergent was hosed off from the wheel. The wheel was observed to be thoroughly cleaned.

EXAMPLE 3

A detergent for cleaning tire wheels was prepared to have the following composition:

| | |
|---|---|
| Sodium alkylbenzene sulfonate | 1% by weight |
| Sodium alkylsulfosuccinate | 1.5% by weight |
| Deionized water | residual amount |
| Isopropyl alcohol | 5% by weight |
| Phenolphthalein | 0.005% by weight |
| Blue pigment (1% aqueous solution) | 2% by weight |
| Morpholine | 2% by weight |

The resulting detergent was sprayed onto the dirty surface of a tire wheel in the same manner as in Example 1. Thus, the detergent was foam-sprayed onto the entire surface of the wheel and had a violet color as sprayed, and then left standing for a while as it was. The color of the detergent gradually faded, and finally the detergent turned blue. Thereafter, the detergent was hosed off from the wheel. The wheel was observed to be fully cleaned.

EXAMPLE 4

A detergent for cleaning tire wheels was prepared in an emulsified state to have the following composition:

| | |
|---|---|
| Sodium alkylbenzene sulfonate | 4% by weight |
| Sodium alkylsulfosuccinate | 2% by weight |
| Synthetic hydrocarbon solvent ("Isopar M" mentioned above) | 40% by weight |
| Silicone Oil | 3% by weight |
| Deionized water | residual amount |
| Phenolphthalein | 0.005% by weight |
| Blue pigment (1% aqueous solution) | 5% by weight |
| Ethanol | 5% by weight |
| Morpholine | 2% by weight |

The thus obtained emulsified detergent was packed in a hand-spray container, and sprayed onto the surface of a tire wheel made of aluminum from the hand-spray container. Thus, the detergent was deposited in a foamy state on the entire surface of the wheel and had a violet color as sprayed, and then left standing for a while as it was. The color of the detergent gradually faded, and finally the detergent turned blue. Thereafter, the detergent was hosed off from the wheel. The wheel was observed to be fully cleaned.

EXAMPLE 5

A detergent for cleaning tire wheels was prepared in an emulsified state to have the following composition:

| | |
|---|---|
| Sodium alkylbenzene sulfonate | 1% by ,weight |
| Sodium alkylsulfosuccinate | 1.5% by weight |
| Deionized water | residual amount |
| Synthetic hydrocarbon solvent ("Isopar M" mentioned above) | 40% by weight |
| Ethanol | 5% by weight |
| Phenolphthalein | 0.005% by weight |
| Ammonium benzoate | 0.5% by weight |
| Ammonia | 1% by weight |

The resulting emulsified detergent was sprayed onto the dirty surface of a tire wheel in the same manner as in Example 4. Thus, the detergent was deposited in a foamy state on the entire surface of the wheel and had a pink color as sprayed, and then left standing for a while as it was. The color of the detergent gradually faded, and finally the detergent turned colorless. Thereafter, the detergent was removed from the wheel by washing with water. The wheel was observed to be fully cleaned.

EXAMPLE 6

A detergent for cleaning tire wheels was prepared to have the following composition:

| | |
|---|---|
| Sodium alkylbenzene sulfonate | 1% by weight |
| Sodium alkylsulfosuccinate | 1.5% by weight |
| Deionized water | residual amount |
| Ethanol | 5% by weight |
| Phenolphthalein | 0.005% by weight |
| Ammonia | 0.5% by weight |
| Ammonium benzoate | 0.5% by weight |

The resulting detergent was packed in a hand-spray container and sprayed onto the dirty surface of a tire wheel. Thus, the detergent was deposited in a foamy state on the entire surface of the wheel and had a pink color as sprayed, and then left standing for a while as it was. The color of the detergent gradually faded, and finally the detergent turned colorless. Thereafter, the detergent was hosed off from the wheel. The wheel was observed to be fully cleaned.

EXAMPLE 7

0.01% by weight of thymol phthalein was added to the composition of Example 1. The cleaning of a tire wheel was conducted in the same manner as in Example 1. The detergent turned from violet to colorless. The same cleaning effect was obtained.

According to the present invention is provided a detergent for cleaning tire wheels, which enables one to recognize the point when the ability to remove the grime becomes lost by color change of the detergent. Use of the detergent of the present invention can eliminate such problems of prior art that the detergent is wiped off or washed away before the grime on the wheels is completely removed, which results in insufficient cleaning, or the wheels are inconveniently damaged by the detergent depositing on them unnecessarily long even though the grime is completely removed by taking it into the detergent.

What is claimed is:

1. A detergent for cleaning tire wheels, which is applied in a foamy state onto the tire wheels, thereby allowing grime sticking onto the surface of the tire wheels to come off from the surface, which comprises an anionic surfactant, wherein said anionic surfactant is a mixture of alkylbenzene sulfonates and alkylsulfosuccinates, at least one alkali compound selected from the group consisting of ammonia and amino group-containing alkali compounds, and a color chance indicator capable of changing its own color when turned from an alkaline condition to a neutral condition, in which the alkali compound is contained in the detergent in such an amount that the compound is eliminated from the detergent by reaction with carbon dioxide for the same period of time as required to release most amounts of grime from the surface of tire wheels.

2. A method of cleaning tire wheels, which comprises depositing onto a tire wheel in a foamed state, a detergent which comprises a surfactant, at least one alkali compound selected from the group consisting of ammonia and amino group-containing alkali compounds, and a color change indicator capable of changing its color when turned from an alkali condition to a neutral condition, and in which the alkali compound is present in an amount such that said alkali compound is eliminated from the deterrent by reaction with carbon dioxide over a period of time required to release most amounts of grime from the surface of the tire wheel, and removing the foamed detergent from the tire wheel when the foamed detergent changes color.

3. The detergent according to claim 1, further containing one or both of pigments and dyes.

4. The detergent according to claim 1, wherein said amino-containing alkali compound is at least one selected from the group consisting of morpholine and alkanolamine.

5. The detergent according to claim 1, wherein said color change indicator is phenolphthalein.

6. The detergent according to claim 1, wherein said color change is a mixture of phenolphthalein and thymolphthalein.

7. The method according to claim 2, wherein the detergent further contains one or both of pigments and dyes.

8. The method according to claim 2, wherein said amino-containing alkali compound is at least one selected from the group consisting of morpholine and alkanolamine.

9. The method according to claim 2, wherein said color change indicator is phenolphthalein.

10. The method of claim 2, wherein said color change is a mixture of phenolphthalein and thymolphthalein.

* * * * *